US008919925B2

(12) United States Patent
Maeshima et al.

(10) Patent No.: US 8,919,925 B2
(45) Date of Patent: Dec. 30, 2014

(54) INKJET IMAGE FORMING APPARATUS AND INK CONTAINER

(71) Applicant: KYOCERA Document Solutions Inc., Osaka (JP)

(72) Inventors: Masanobu Maeshima, Osaka (JP); Tatsuya Yamanaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 13/928,177

(22) Filed: Jun. 26, 2013

(65) Prior Publication Data

US 2014/0002554 A1 Jan. 2, 2014

(30) Foreign Application Priority Data

Jun. 29, 2012 (JP) ..... 2012-146679

(51) Int. Cl.
*B41J 2/14* (2006.01)
*B41J 2/175* (2006.01)

(52) U.S. Cl.
CPC ..... *B41J 2/17523* (2013.01); *B41J 2/17553* (2013.01); *B41J 2/17513* (2013.01); *B41J 2/1752* (2013.01)
USPC ..... 347/49; 347/86

(58) Field of Classification Search
USPC ..... 347/49, 85, 86
See application file for complete search history.

(56) References Cited

U.S. PATENT DOCUMENTS 4,914,453 A * 4/1990 Kanayama et al. ..... 347/86
5,825,388 A * 10/1998 Sasaki ..... 347/86
6,102,533 A * 8/2000 Nozawa et al. ..... 347/86
6,793,330 B2 * 9/2004 Usui et al. ..... 347/86
7,367,659 B2 5/2008 Yazawa
2004/0227792 A1 11/2004 Iijima et al.
2006/0044370 A1 3/2006 Yazawa

FOREIGN PATENT DOCUMENTS

JP H05-278227 A 10/1993
JP H09-240004 A 9/1997
JP 2001-026115 A 1/2001
JP 2001-334677 A 12/2001
JP 2004-237495 A 8/2004
JP 2004-299287 A 10/2004
JP 2006-88697 A 4/2006

OTHER PUBLICATIONS

An Office Action; "Notice of Reasons for Rejection," issued by the Japanese Patent Office on Sep. 16, 2014, which corresponds to Japanese Patent Application No. 2012-146679 and is related to U.S. Appl. No. 13/928,177.

The first Office Action issued by the Chinese Patent Office on Oct. 30, 2014, which corresponds to Chinese Patent Application No. 201310250673.8 and is related to U.S. Appl. No. 13/928,177.

* cited by examiner

*Primary Examiner* — Anh T. N. Vo
(74) *Attorney, Agent, or Firm* — Studebaker & Brackett PC

(57) ABSTRACT

An inkjet image forming apparatus includes an ink container and a container installed part. The ink container is configured to store an ink. To the container installed part, the ink container is attached/detached along an installing direction. The ink container includes a container case and a shutter. The container case has a lower face to which a supplying port discharging the ink is located. The shutter is located to leave a space from the supplying port and switchable between a closing state covering a bottom of the supplying port and an opening state exposing the supplying port.

18 Claims, 10 Drawing Sheets

INKJET IMAGE FORMING APPARATUS AND INK CONTAINER

INCORPORATION BY REFERENCE

This application is based on and claims the benefit of priority from Japanese Patent application No. 2012-146679 filed on Jun. 29, 2012, the entire contents of which are incorporated herein by reference.

BACKGROUND

The present disclosure relates to an inkjet image forming apparatus and an ink container storing an ink used in this inkjet image forming apparatus.

An inkjet image forming apparatus forms an image on a sheet surface by discharging an ink from a recording head to a sheet. The ink discharged from the recording head to the sheet is supplied from an ink container to the recording head and the ink container includes a supplying port discharging the ink.

In such a inkjet image forming apparatus, if the above-mentioned image forming operation is repeatedly carried out, the ink in the ink container is accordingly decreased. When the ink in the ink container then has run out, it is necessary to replace the ink container. Therefore, the ink container is attachably/detachably installed to a container installed part arranged in the inkjet image forming apparatus As the above-mentioned ink container, there is an ink container having a shutter opening/closing the supplying port. Thus, by providing the shutter opening/closing the supplying port, it is possible to prevent the ink from leaking by vibration caused by an attachment/detachment of the ink container to the container installed part.

SUMMARY

In accordance with an embodiment of the present disclosure, an inkjet image forming apparatus includes an ink container and a container installed part. The ink container is configured to store an ink. To the container installed part, the ink container is attached/detached along an installing direction. The ink container includes a container case and a shutter. The container case has a lower face to which a supplying port discharging the ink is located. The shutter is located to leave a space from the supplying port and switchable between a closing state covering a bottom of the supplying port and an opening state exposing the supplying port.

Furthermore, in accordance with an embodiment of the present disclosure, an ink container stores an ink and is attached/detached to a container installed part provided in an inkjet image forming apparatus along an installing direction. The ink container includes a container case and a shutter. The container case has a lower face to which a supplying port discharging the ink is located. The shutter is located to leave a space from the supplying port and switchable between a closing state covering a bottom of the supplying port and an opening state exposing the supplying port.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
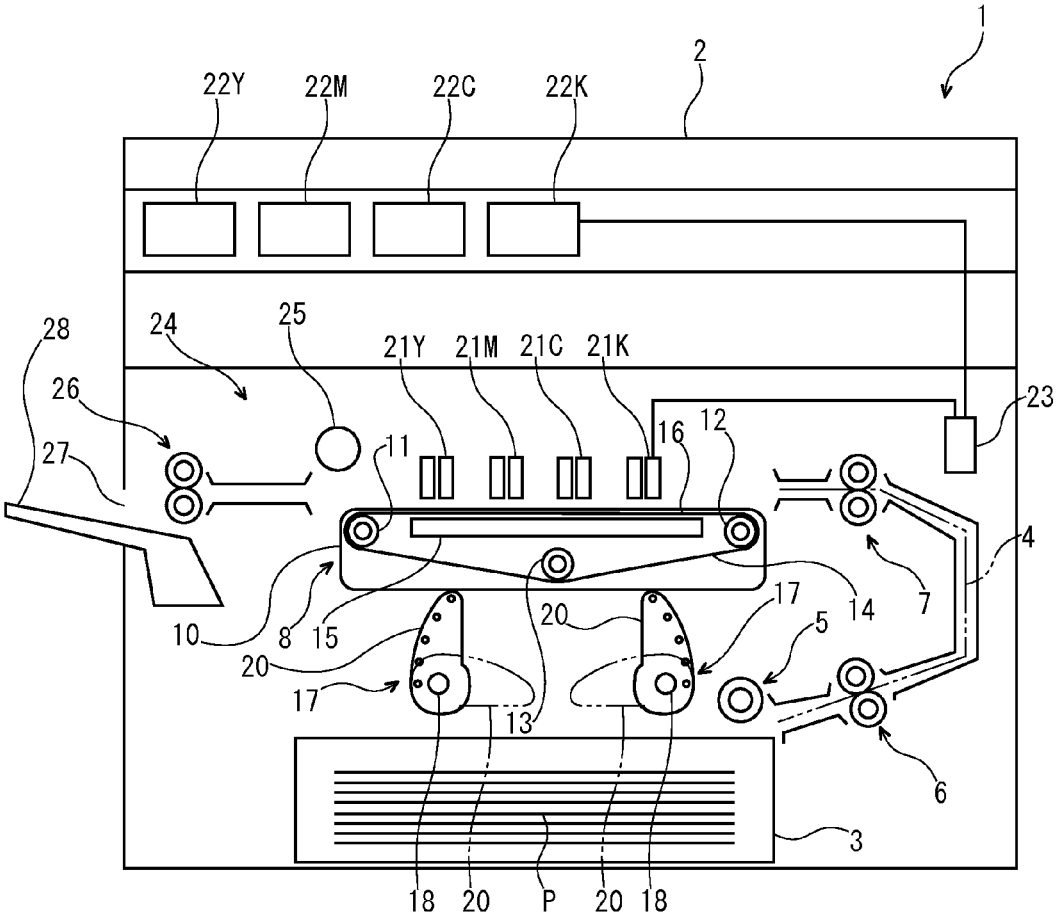
FIG. 1 is a schematic diagram schematically showing a printer according to an embodiment of the present disclosure.

First, with reference to FIG. 1, the entire structure of an inkjet color printer (an inkjet image forming apparatus) 1 will be described. Hereinafter, the inkjet color printer 1 is called as a "printer 1". Hereinafter, it will be described so that the front side of the printer 1 is positioned at this side (a reader's side) of FIG. 1. An "outside" indicates an outside in left and right directions or a horizontal direction and an "inside" indicates an inside in the left and right directions, unless another case is specified.

The printer 1 includes a box-formed printer main body 2. To a lower part of the printer main body 2, a sheet feeding cartridge 3 configured to store sheets P is installed.

In a right part of the printer main body 2, a conveying path 4 for the sheet P is arranged. Ata lower end of the conveying path 4, a sheet feeding roller 5 is positioned near the sheet feeding cartridge 3 and, at the right side of the sheet feeding roller 5, conveying rollers 6 are positioned. At an upper end of the conveying path 4, resist rollers 7 are positioned.

In an intermediate part of the printer main body 2, an upward/downward movable conveying unit 8 is attached. The conveying unit 8 includes a conveyance frame 10, a driving roller 11, a follower roller 12, a tension roller 13, an endless conveyance belt 14 and an air intake duct 15. The driving roller 11 is rotatably supported at a left upper corner of the conveyance frame 10. The follower roller 12 is rotatably supported at a right upper corner of the conveyance frame 10. The tension roller 13 is rotatably supported at a middle lower part of the conveyance frame 10. The conveyance belt 14 is wound around the driving roller 11, follower roller 12 and tension roller 13. The air intake duct 15 is located so as to be surrounded by the conveyance belt 14.

An upper face of the conveyance belt 14 is a roughly flat conveyance face 16. The conveyance belt 14 has a lot of air intake holes (not shown) and a top face of the air intake duct 15 also has a lot of air intake holes (not shown). The air intake duct 15 is connected with a suction device (not shown), such as a suction pomp. Accordingly, by activating the suction device, an air can be sucked via the air intake holes of the conveyance belt 14 and the air intake holes of the air intake duct 15 from the conveyance face 16 side in the conveyance belt 14 to the air intake duct 15 side.

In an intermediate lower part of the printer main body 2, a pair of left and right elevating devices 17 is attached below the conveying unit 8. Each elevating device 17 includes a rotation axis 18 and a cam 20 supported by the rotation axis 18. The cam. 20 is connected with a driving device (not shown), such as a driving motor. Accordingly, by activating the driving device, each cam. 20 rotates around the rotation axis 18 so that a posture of the cam 20 is switched between an upright posture (refer to solid line in FIG. 1) and a laid-down posture (refer to two-dot chain line in FIG. 1). The cam 20 is switched to the upright posture to lift up the conveyance frame 10 and to move the conveying unit 8 upward or switched to the laid-down posture to release the lift of the conveyance frame 10 and to move the conveying unit 8 downward.

In the intermediate part of the printer main body 2, four recording heads 21 (21K, 21C, 21M, 21Y) are arranged in parallel. The recording heads 21 correspond to black (K), cyan (C), magenta (M) and yellow (Y) from an upper stream side (a right side in the embodiment) in order of a conveying direction of the sheet P. Hereinafter, except for the description to be specified by the colors, the reference characters "Y", "C", "M" and "K" with regard to the recording heads 21 are omitted. The recording heads 21 are provided with respective nozzles (not shown) facing to the conveyance face 16 of the conveyance belt 14.

In the upper part of the printer main body 2, four ink containers 22 (22K, 22C, 22M, 22Y) are installed in parallel. The ink containers 22 store respective inks of black (K), cyan (C), magenta (M) and yellow (Y) from an upper stream side (a right side in the embodiment) in order of the conveying direction of the sheet P. Hereinafter, except for the description to be specified by the colors, the reference characters "Y", "C", "M" and "K" with regard to the ink containers 22 are omitted.

Each ink container 22 is connected with each recording head 21 via a sub container 23 so that the ink stored in the ink container 22 is temporarily retained in the sub container 23 and then supplied to the recording head 21. The sub container 23 is provided corresponding to each color of black (K), cyan (C), magenta (M) and yellow (Y) similar to the recording heads 21 and ink containers 22. In FIG. 1, the sub container 23 corresponding to black (K) is illustrated and the other sub containers 23 corresponding to the other colors are omitted.

In a left part of the printer main body 2, an ejecting mechanism 24 is arranged. The ejecting mechanism 24 includes a drying device 25, ejecting rollers 26 and a sheet ejecting tray 28. The drying device 25 is located at the left upper side of the conveying unit 8. The ejecting rollers 26 are located at the left side of the drying device 25. The sheet ejecting tray 28 is located below the ejecting rollers 26 and protruded outside of the printer main body 2 via an ejecting port 27.

Next, the operation of forming an image by the printer 1 having such a configuration will be described.

In the printer 1, when image data is received from an external computer or the like, the sheet P stored in the sheet feeding cartridge 3 is fed to the conveying path 4 by the sheet feeding roller 5. The sheet P fed to the conveying path 4 is conveyed to a lower stream side of the conveying path 4 by the conveying rollers 6 and fed from the conveying path 4 to the conveyance face 16 of the conveyance belt 14 by the resist rollers 7.

The sheet P fed to the conveyance face 16 of the conveyance belt 14 is absorbed to the conveyance face 16 of the conveyance belt 14 by suction force of the suction device (not shown) connected with the air intake duct 15. To the sheet P absorbed to the conveyance face 16, each recording head 21 discharges the ink on the basis of the information of the image data received from the external computer or the like. Thereby, a color ink image is formed on the sheet P. The sheet P having the color ink image is advanced so that the ink on the surface is dried by the drying device 25, and then, ejected on the sheet ejecting tray 28 by the ejecting rollers 26.

Next, the upper part of the printer main body 2 will be described in detail. Arrows Fr shown in FIG. 2 and following figures indicate the front side of the printer 1.

Figure 2:
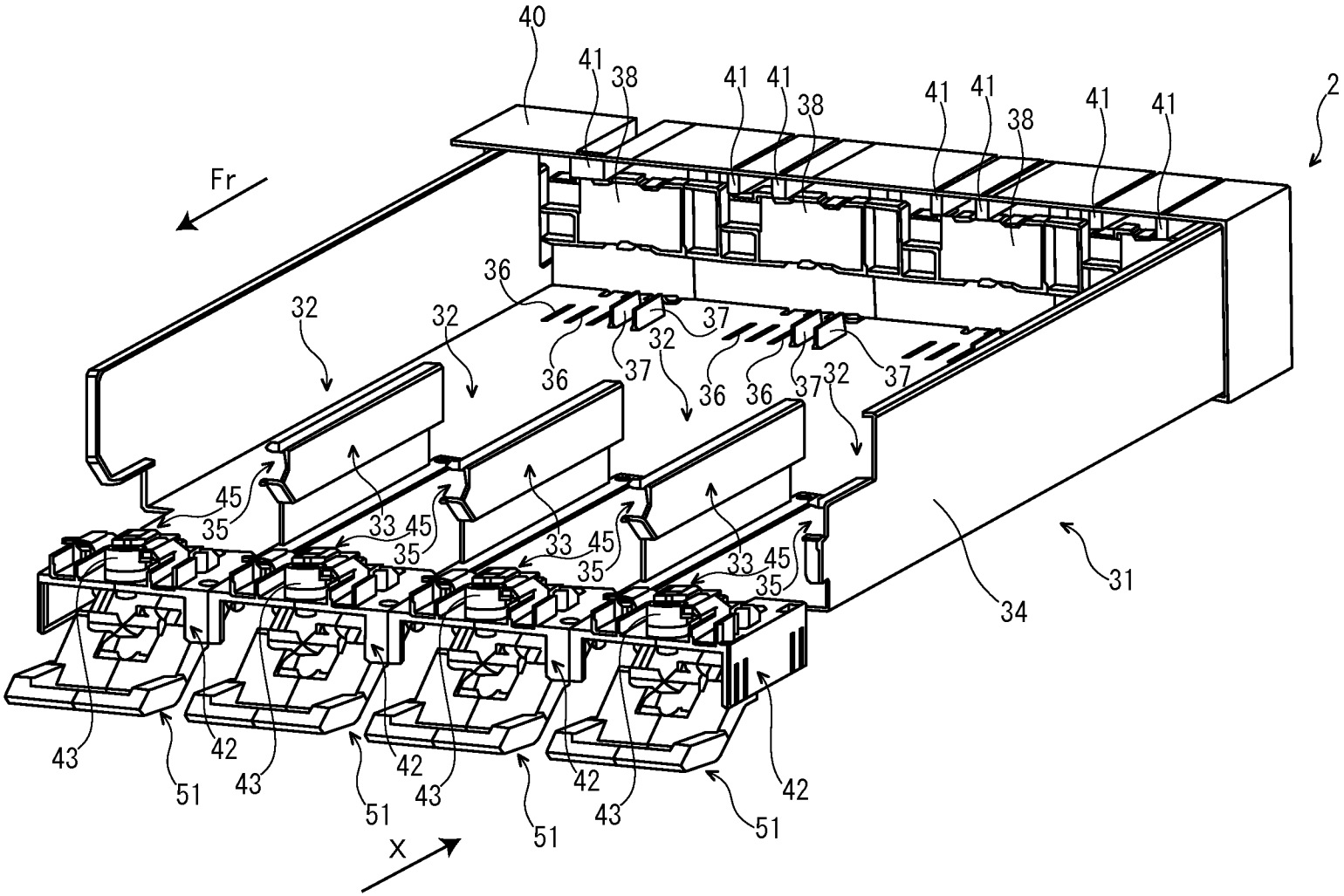
FIG. 2 is a perspective view showing the printer in a situation, in which ink containers are detached from respective container installed parts, according to the embodiment of the present disclosure.
Figure 3:
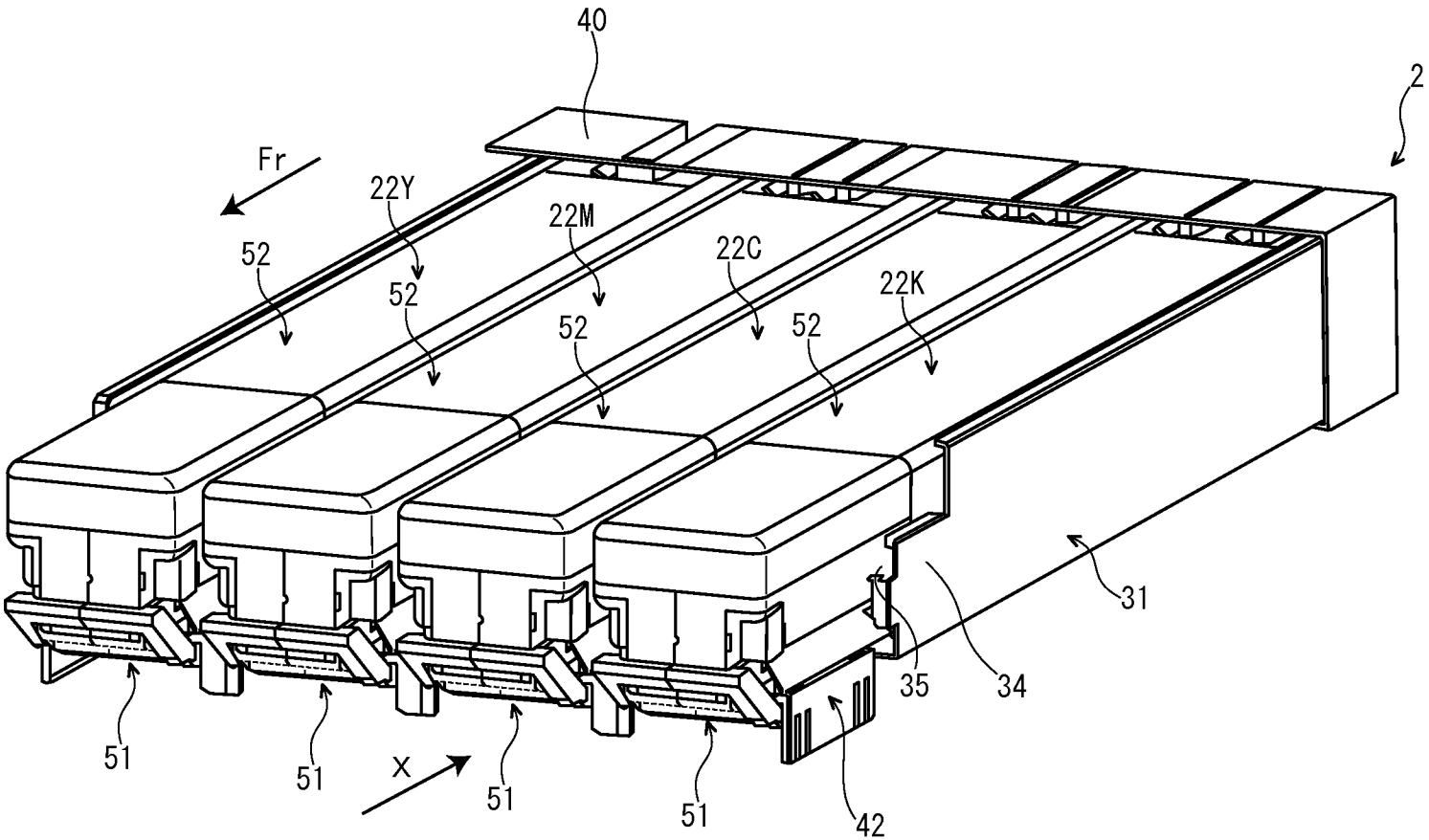
FIG. 3 is a perspective view showing the printer in a situation, in which the ink containers are attached to the respective container installed parts, according to the embodiment of the present disclosure.

As shown in FIG. 2, in the upper part of the printer main body 2, an installation frame 31 having opened top face and front face is provided. In the installation frame 31, four container installed parts 32 extending in forward and backward directions or a depth direction are arranged in parallel so that, to the container installed parts 32, the respective ink containers 22 are attachably/detachably installed along the forward/backward directions (refer to FIG. 3). In the embodiment, the front side of the printer 1 is front side (a user's side) in an installing direction of the ink container 22 to the container installed part 32 and the rear side of the printer 1 is a rear side in the installing direction of the ink container 22 to the container installed part 32. Arrows A shown in FIG. 2 and following figures indicate the installing direction of the ink container 22 to the container installed part 32.

As shown in FIG. 2, in a front part of the top face of the installation frame 31, three partition boards 33 extending in the forward/backward directions are stood at intervals in the left/right directions so that the container installed parts 32 are partitioned by the partition boards 33. In the partition boards 33 and a right wall 34 of the installation frame 31, guide grooves 35 are formed.

To a rear part of the top face of the installation frame 31, five slit-liked fixing holes 36 are formed at positions respectively corresponding to the container installed parts 32. To right two of the five fixing holes 36, lower protrusions 37 are fixed. To a rear face of the installation frame 31, RFID sensing circuit boards 38 are attached at positions respectively corresponding to the container installed parts 32. On a rear end of the installation frame 31, an upper frame 40 extending in the left/right directions is attached. On a bottom face of the upper frame 40, upper protrusions 41 are formed at positions respectively corresponding to the container installed parts 32.

Figure 4:
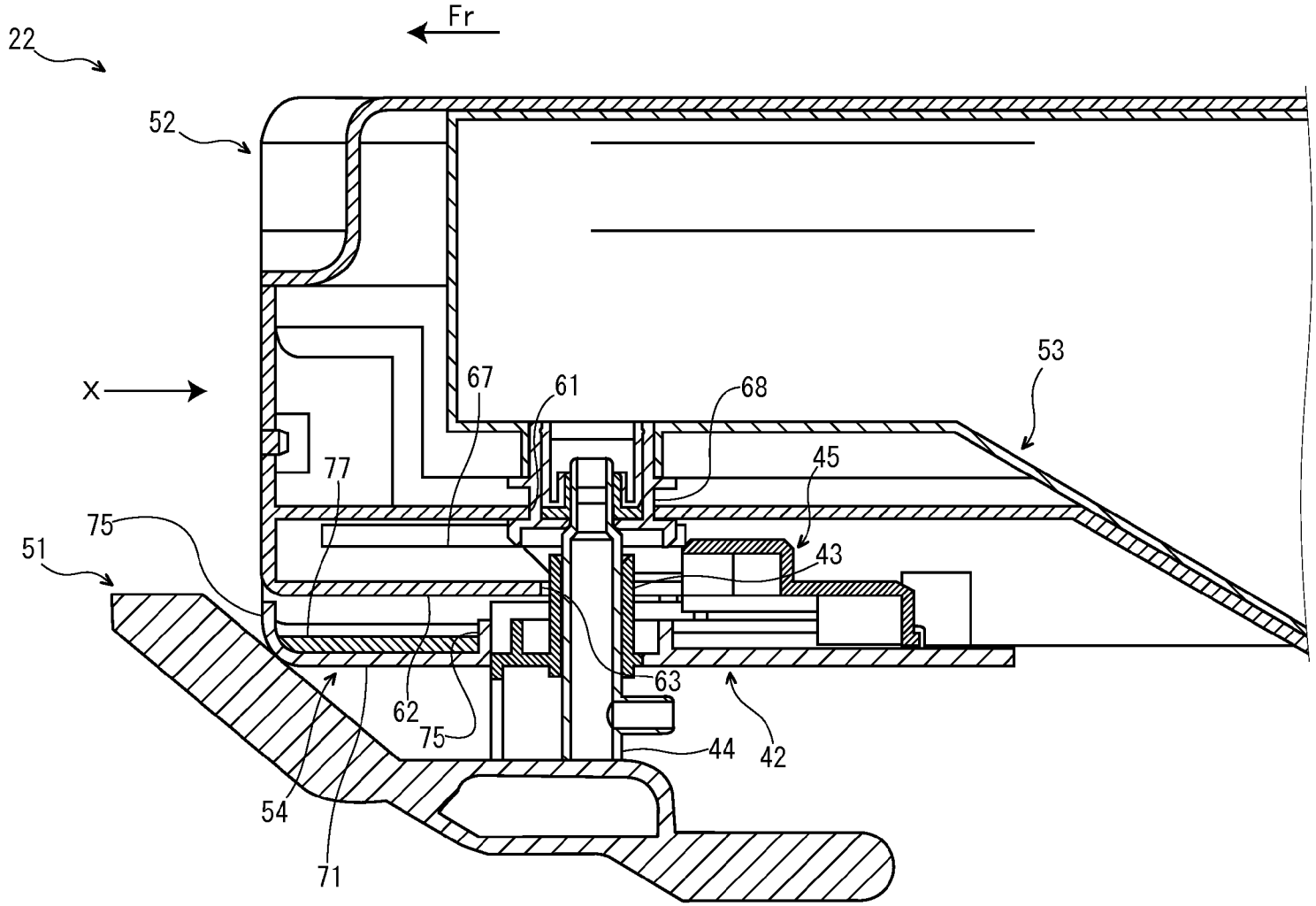
FIG. 4 is a sectional view showing a front part and the circumference of the ink container in the printer according to the embodiment of the present disclosure.

In front of the installation frame 31, container installing guides 42 are respectively provided at positions as front ends of the container installed parts 32. In centers of front parts of the container installing guides 42, cylinder-liked guide pipes 43 are respectively attached. As shown in FIG. 4, inside each guide pipe 43, a needle 44 is installed in an upward/downward movable state. The needle 44 is connected with the sub container 23 (refer to FIG. 1).

Figure 5A:
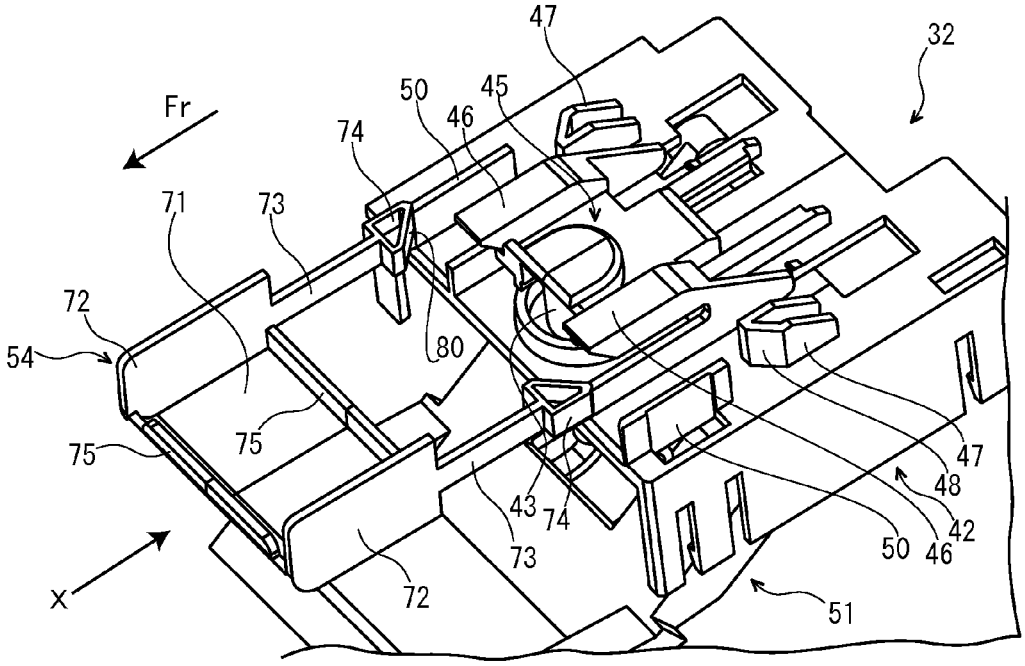
FIG. 5A is a perspective view showing the printer in a situation, in which a main body side shutter covers a needle, according to the embodiment of the present disclosure.
Figure 5B:
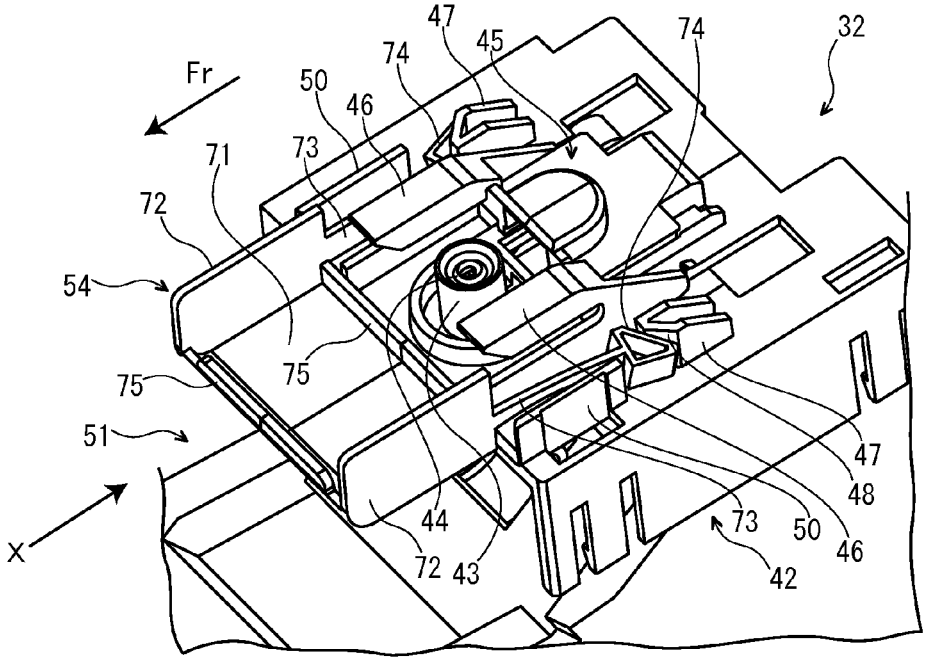
FIG. 5B is a perspective view showing the printer in another situation, in which the main body side shutter exposes a needle, according to the embodiment of the present disclosure.

As shown in FIGS. 5A and 5B, to upper face side of each container installing guides 42, main body side shutters 45 are respectively attached. The main body side shutter 45 can move between a position covering the needle 44 (refer to FIG. 5A) and another position exposing the needle 44 (refer to FIG. 5B) in the forward/backward directions. On the upper face of each container installing guide 42, guide pieces 46 are protruded at both left and right sides of the main body side shutter 45. On the upper face side of each container installing guide 42, first guide protrusions 47 are protruded outside of the respective guide pieces 46. In a front end of each first guide protrusion 47, a guide face 48 is formed to incline backward and outside. In front of the first guide protrusion 47, a second guide protrusion 50 extending in the forward/backward directions is protruded.

As shown in FIG. 4, below the container installing guides 42, levers 51 are respectively attached. Each lever 51 is supported by the container installing guide 42 to be swingable in upward and downward directions. The lever 51 is located below the needle 44.

Next, the ink container 22 will be described in detail.

As shown in FIG. 4, each ink container 22 includes a box-formed container case 52, a pouch pack 53 housed in the container case 52 and a container side shutter (a shutter) 54 installed to a front lower end of the container case 52.

Figure 6:
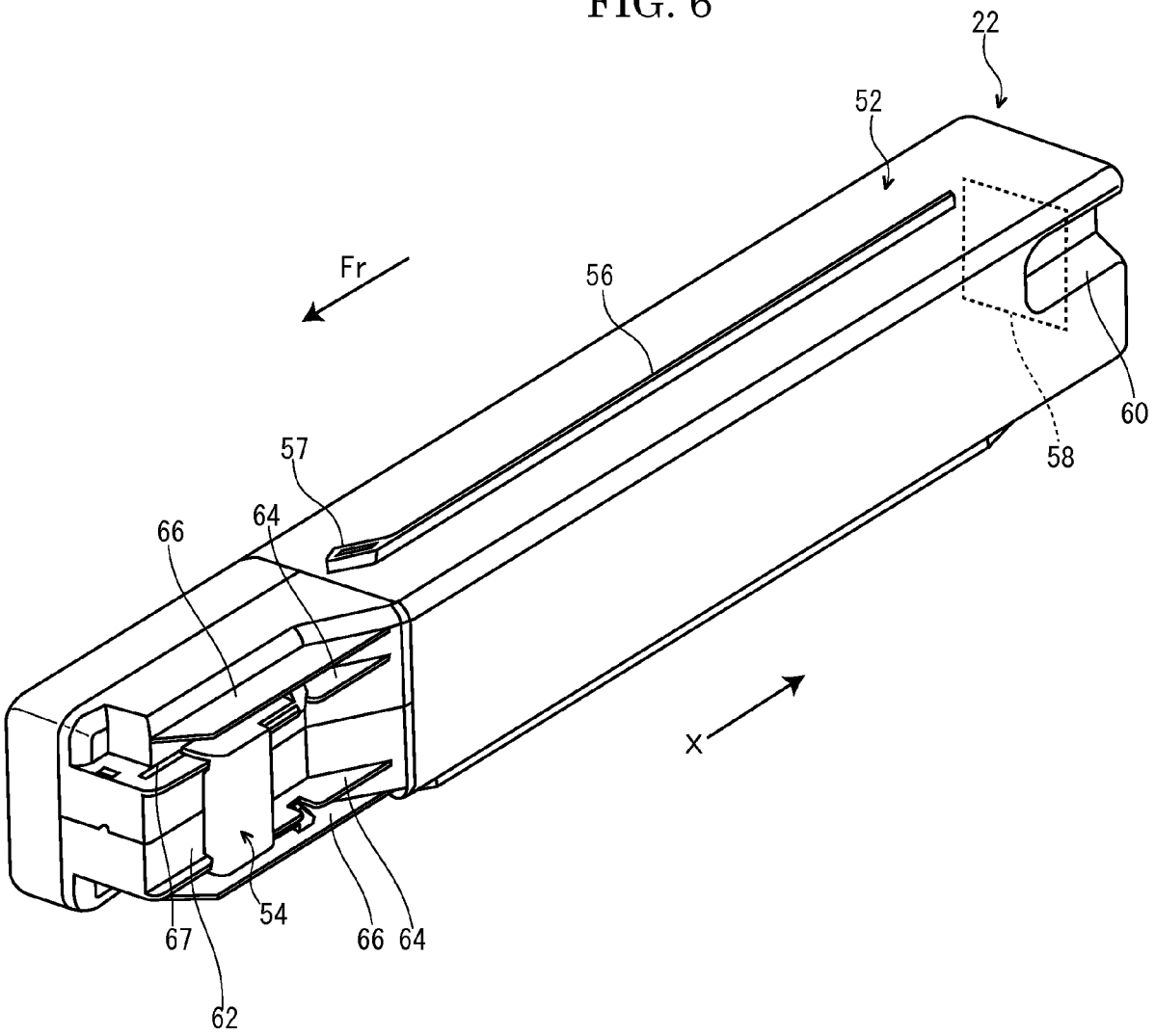
FIG. 6 is a perspective view showing the ink container in the printer according to the embodiment of the present disclosure.

First, the container case 52 will be described. As shown in FIG. 6, the container case 52 is formed in an extended shape in the forward/backward directions. The container case 52 has a capacity of housing the pouch pack 53. On a side part of the container case 52, a guide rib 56 extending in the forward/backward directions is protruded so that the guide rib 56 can be inserted in the guide groove 35 (refer to FIG. 2) of the container installed part 32. In a front end of the guide rib 56, an inclined part 57 inclining forward and upward is formed. To a rear face of the container case 52, an RFID tag 58 is fixed. Then, the ink container 22 and container installed part 32 are configured so that, in a condition of having the ink container 22 installed to the container installed part 32, a wireless communication is carried out between the RFID sensing circuit board 38 of the container installed part 32 and RFID tag 58 of the ink container 22.

In a rear end of an upper face of the container case 52, an upper depression (not shown) is formed. When the ink container 22 is installed to the container installed part 32, the upper protrusion 41 of the container installed part 32 engages with the upper depression. In a rear end of a lower face of the container case 52, a lower depression 60 is formed. When the ink container 22 is installed to the container installed part 32, the lower protrusion 37 of the container installed part 32 engages with the lower depression 60. As shown in FIG. 4, in a front end of a bottom face of the container case 52, a spout inserting hole 61 is bored in the upward/downward directions.

Figure 7A:
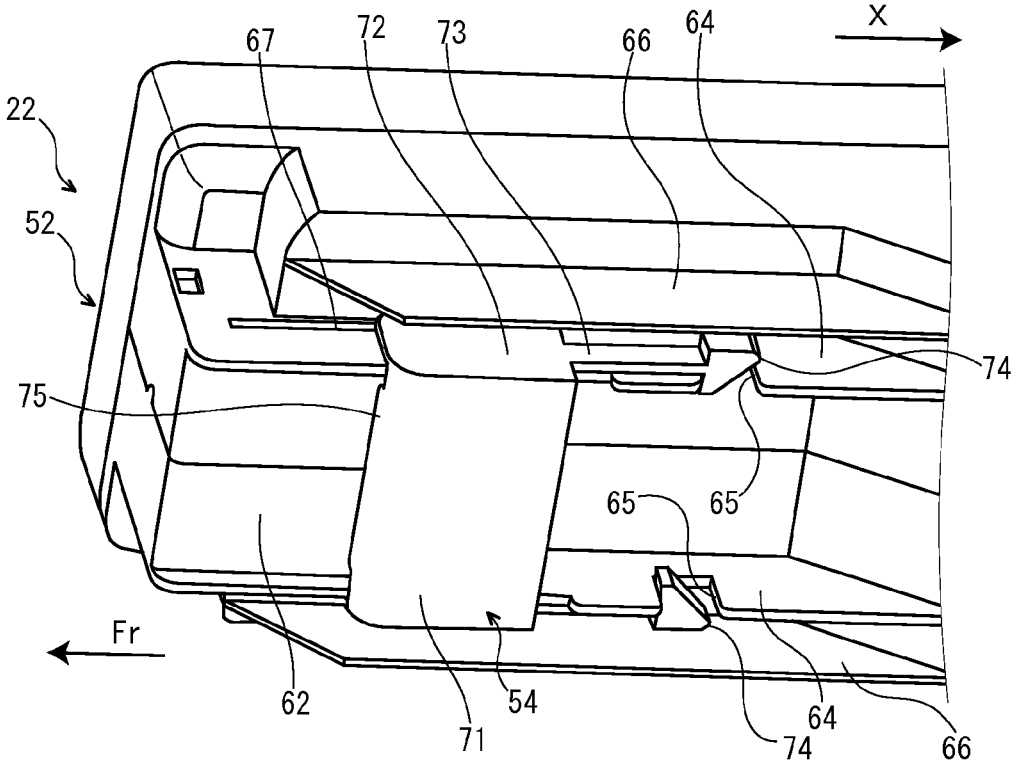
FIG. 7A is a bottom perspective view showing the printer in a situation, in which a container side shutter is a closing state, according to the embodiment of the present disclosure.
Figure 7B:
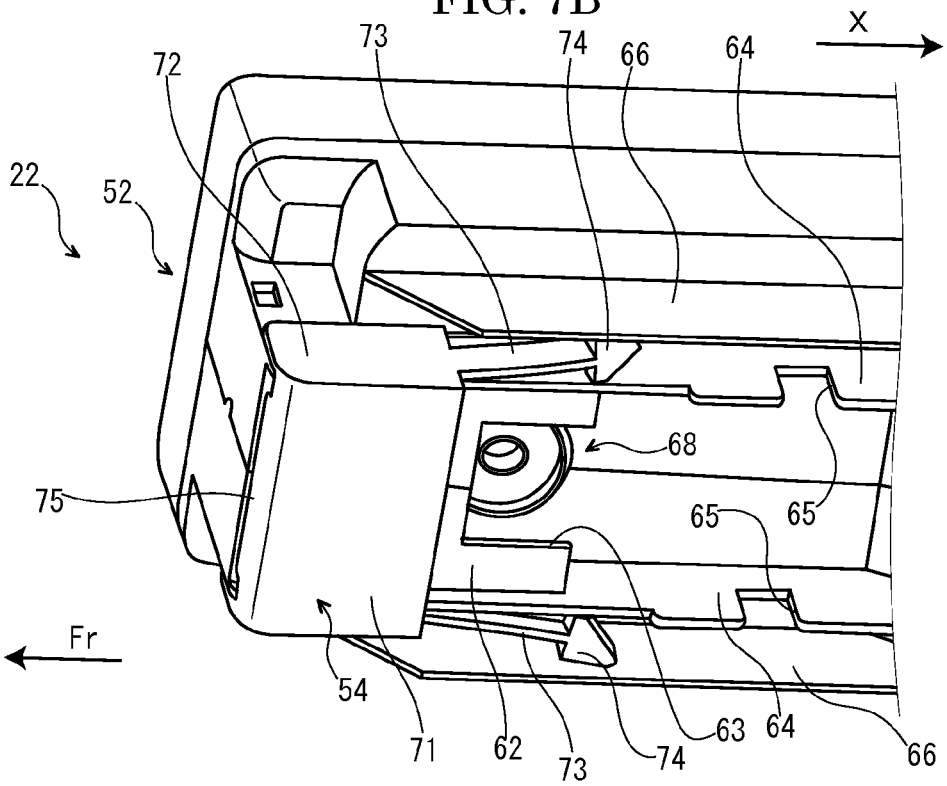
FIG. 7B is a bottom perspective view showing the printer in another situation, in which the container side shutter is an opening state, according to the embodiment of the present disclosure.

As shown in FIG. 7A, in the front end of the container case 52, a bottom end board 62 is provided. As shown in FIG. 7B, in a rear end of the bottom end board 62, a notch 63 is formed. As shown in FIGS. 7A and 7B, in the front end of a bottom face of the container case 52, a pair of left and right engaging boards 64 extending in the forward/backward directions are provided. In rear parts of the engaging boards 64, engaging depressions 65 are respectively formed. In the front end of a bottom face of the container case 52, supporting boards 66 extending in the forward/backward directions are respectively provided outside of the engaging boards 64. In the front end of the container case 52, grooves 67 extending in the forward/backward directions are formed.

Next, the pouch pack 53 will be described. The pouch pack 53 contains the ink and is formed like a bag. The pouch pack 53 is made of pliability (flexible) film material. This film material is formed by laminating a plurality of resins and aluminums. As an example, from a top surface in order, polyester (PET), aluminum (AL), nylon (PA) and low level density polyethylene (LLDPE) are laminated. Because the top surface is made of polyester, the external appearance and the strength of the pouch pack 53 can be increased. Because an aluminum layer is made, gas barrier property of the pouch pack 53 can be increased. A nylon layer enables impact resistance and mechanical strength of the pouch pack 48 to be increased. Because a back surface is made of low level density polyethylene, it is possible to heighten welding strength when the film material is shaped like a bag by welding, and then, to increase sealing quality.

As shown in FIG. 4, in a front end of the pouch pack 53, a cylinder-liked spout (a supplying port) 68 is welded so that the ink contained in the pouch pack 53 can be ejected via the spout 68. The spout 68 is inserted in the spout inserting hole 61 of the container case 52. Accordingly, the pouch pack 53 is fixed in the container case 52 so that the spout 68 is pointed downward. As shown in FIG. 7B, the spout 68 is located at a lower face side of the front end of the container case 52.

Figure 8A:
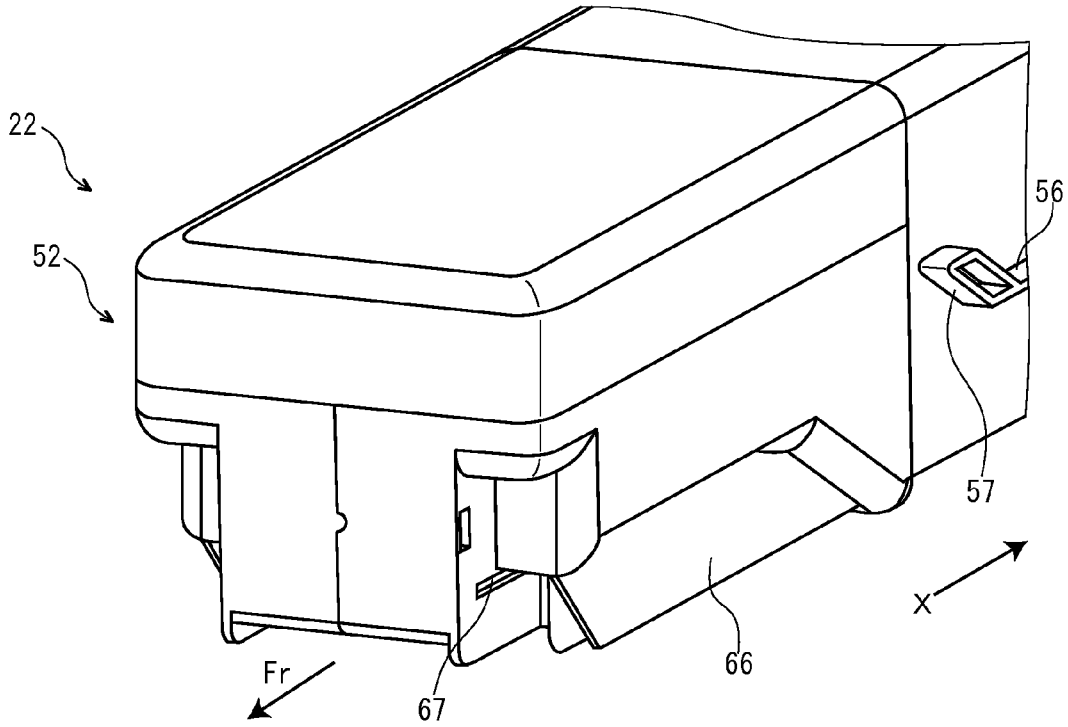
FIG. 8A is a front perspective view showing the printer in a situation, in which the container side shutter is a closing state, according to the embodiment of the present disclosure.
Figure 8B:
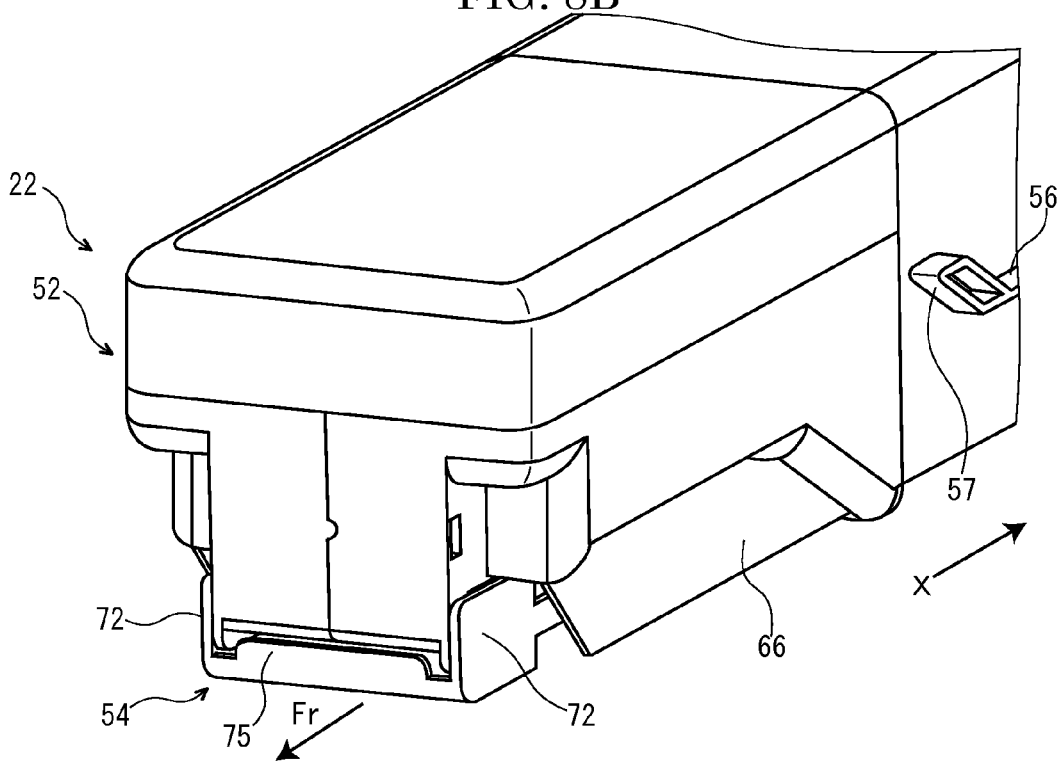
FIG. 8B is a front perspective view showing the printer in another situation, in which the container side shutter is an opening state, according to the embodiment of the present disclosure.
Figure 9A:
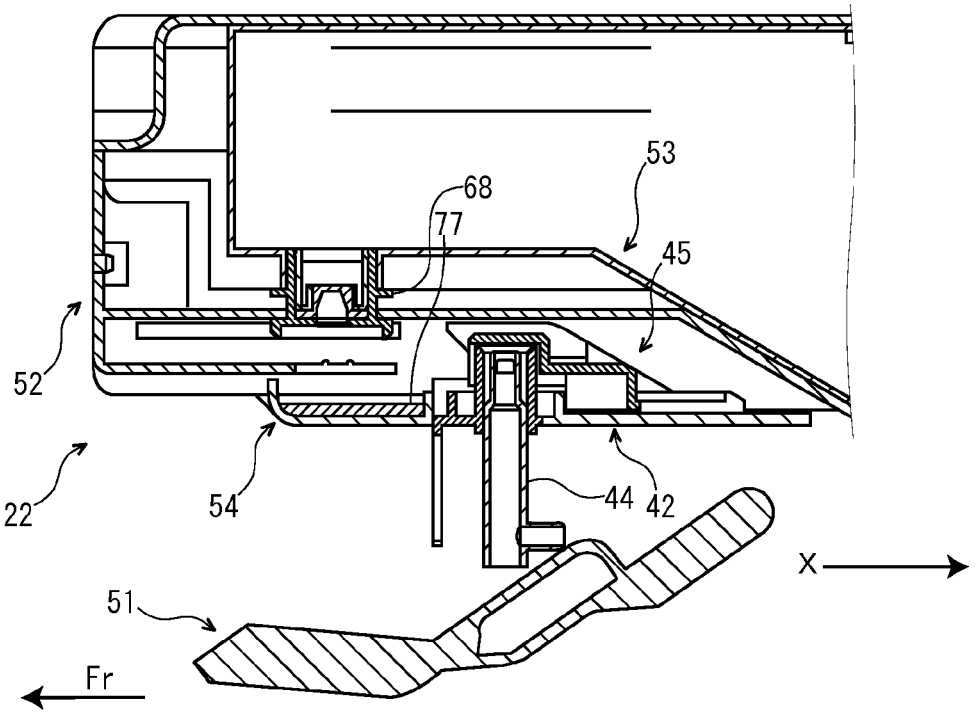
FIG. 9A is a sectional view showing the printer in a situation, in which the container side shutter is a closing state, according to the embodiment of the present disclosure.
Figure 9B:
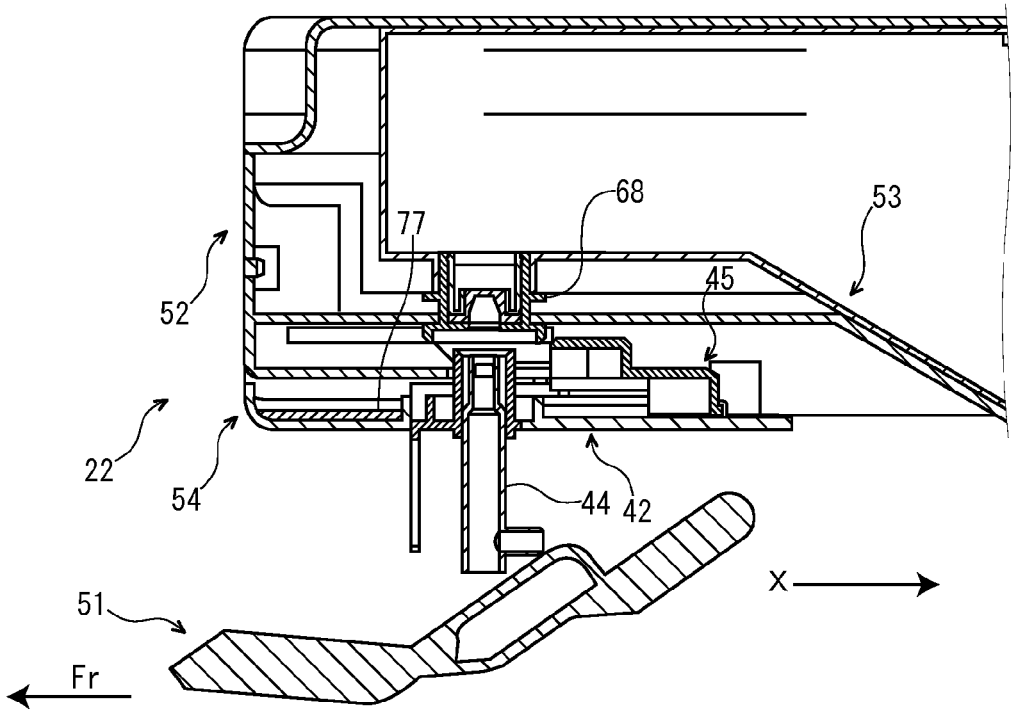
FIG. 9B is a sectional view showing the printer in another situation, in which the container side shutter is an opening state, according to the embodiment of the present disclosure.

Next, the container side shutter 54 will be described. The container side shutter 54 is located below the spout 68 to leave a space from the spout 68. That is, the container side shutter 54 does not come into contact with the spout 68. The container side shutter 54 is supported in the forward/backward movable state by the container case 52, thereby being capable of switching between a closing state covering a bottom of the spout 68 (refer to FIGS. 7A, 8A and 9A) and an opening state exposing the spout 68 (refer to FIGS. 7B, 8B and 9B).

As shown in FIGS. 5A and 5B, the container side shutter 54 includes a bottom board 71, a pair of side boards 72, a pair of extending boards 73 and a pair of hooks 74. The sideboards 72 are respectively protruded upward at both left and right sides of the bottom board 71. The extending boards 73 are respectively extended backward from rear ends of the sideboards 72. The hooks 74 are respectively formed on rear ends of the extending boards 73. In FIGS. 5A and 5B, for easy illustration of the configuration of the container side shutter 54, the container side shutter 54 extracted from the ink container 22 is shown.

On both front and rear ends of the bottom board 71, protruded boards 75 extending in the left/right directions are protruded upward. As shown in FIG. 4, to an upper face of the bottom board 71, a liquid absorbing member 77 is attached. The liquid absorbing member 77 is located to leave a space from the spout 68 in a situation, in which the container side shutter 54 is in the closing state. In the embodiment, in another situation, in which the container side shutter 54 is in the opening state, the liquid absorbing member 77 is located to leave a space from the spout 68. That is, the liquid absorbing member 77 always does not come into contact with the spout 68. For example, the liquid absorbing member 77 is made of a sponge. In FIGS. 5A and 5B, the liquid absorbing member 77 is omitted. As shown in FIG. 5A, each hook 74 has a contact face 80 inclining backward and outside.

In the above-mentioned configuration, in a situation before the ink container 22 is installed or attached to the container installed part 32, as shown in FIG. 7A, the container side shutter 54 is in the closing state. In addition, by engaging the hooks 74 of the container side shutter 54 with the engaging depressions 65 of the engaging boards 64 of the container case 52, movement of the container side shutter 54 to the container case 52 is restricted. Moreover, as shown in FIG. 5A, the needle 44 (not shown in FIG. 5A) of the container installed part 32 is covered by the main body side shutter 45.

Figure 10A:
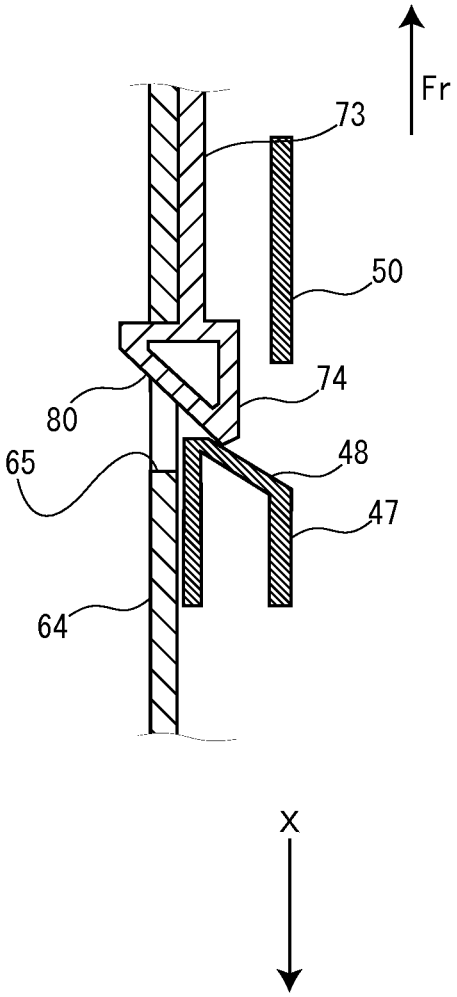
FIG. 10A is a schematic diagram schematically showing the printer in a situation, in which a hook comes into contact with a guide protrusion, according to the embodiment of the present disclosure.

In the middle of installing the ink container 22 to the container installed part 32 from the front of the printer 1, as shown in FIG. 10A, the contact face 80 of the hook 74 of the container side shutter 54 comes into contact with the guide face 48 of the first guide protrusion 47 of the container installing guide 42.

Figure 10B:
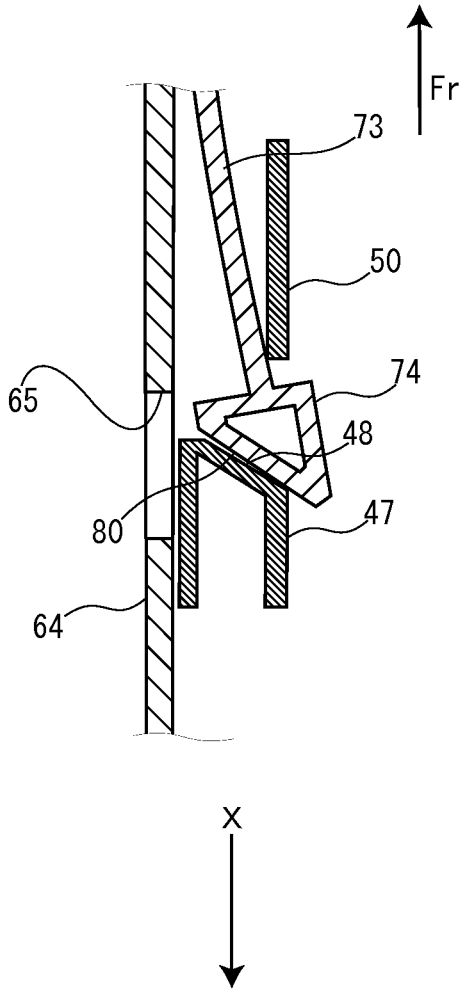
FIG. 10B is a schematic diagram schematically showing the printer in another situation, in which the hook moves outside along the guide protrusion, according to the embodiment of the present disclosure.

Subsequently, when the ink container 22 is pushed to a first position of the container installed part 32, as shown in FIG. 10B, the first guide protrusion 47 stops the hook 74 in an engaged state to restrict the backward movement of the container side shutter 54. Moreover, the hook 74 moves outside along the first guide protrusion 47. Accordingly, the engagement of the hook 74 of the container side shutter 54 with the engaging depressions 65 of the engaging boards 64 of the container case 52 is released, and then, the container side shutter 54 gets in a switchable state from the closing state to the opening state.

In such a state, when the ink container 22 is pushed to a second position being at a rear side of the above-mentioned first position, as shown in FIG. 7B, the container case 52 of the ink container 22 moves backward relatively to the container side shutter 54. Accordingly, the container side shutter 54 is switched from the closing state to the opening state to expose the spout 68. Thus, it is possible to automatically switch the container side shutter 54 from the closing state to the opening state in accordance with an operation of installing the ink container 22 to the container installed part 32.

In addition, according to the above-mentioned backward movement of the container case 52, the ink container 22 pushes the main body shutter 45, and then, as shown in FIG. 5B, the main body shutter 45 moves from the position covering the needle 44 to the other position exposing the needle 44.

Next, when the lever 51 is lifted as shown in FIG. 4, the lever 51 pushes the needle 44 upward so that a top end of the needle 44 is inserted in the spout 68. Thereby, the inside of the needle 44 communicates with the inside of the pouch pack 53, and then, the ink in the pouch pack 53 becomes possible to be supplied to the sub container 23 (refer to FIG. 1) via the needle 44. Thus, it is possible to easily insert the needle 44 in the spout 68 by operating the lever 51 from front side of the printer 1.

On the other side, in order to remove or detach the ink container 22 from the container installed part 32, the lever 51 is pulled down, and then, the ink container 22 is pulled out from the container installed part 32 toward the front side. When the ink container 22 is pulled out to the above-mentioned first position of the container installed part 32, container case 52 moves forward relatively to the container side shutter 54, and accordingly, the container side shutter 54 returns from the opening state to the closing state.

Next, when the ink container 22 is pulled out to a third position being at a front side of the above-mentioned first position, as shown in FIG. 10A, the engaging stop of the hook 74 of the container side shutter 54 with the first guide protrusion 47 of the container installing guide 42 is released, and then, the hook 74 of the container side shutter 54 engages with the engaging depressions 65 of the engaging boards 64 of the container case 52. Accordingly, the movement of the container side shutter 54 to the container case 52 is restricted to keep the closing state of the container side shutter 54. When the ink container 22 is further pulled out to front side, the ink container 22 with keeping the closing state of the container shutter 54 is removed from the container installed part 32. Therefore, it is possible to surely prevent the ink leakage in the removal of the ink container 22.

When the ink container 22 is removed, the ink collected in the spout 68 may drop by vibration. In the embodiment, it is possible to catch the dropped ink by the container side shutter 54 in the closing state, thereby surely preventing the ink leakage out of the ink container 22.

If the container side shutter 54 were coming into contact with the spout 68 and the container side shutter 54 were opening/closing the spout 68, it is possible that the ink adhered around the spout 68 is trailed and spread by the container side shutter 54 to dirty a hand of a worker attaching/detaching the ink container 22 and the inside and circumference of the printer1.

However, in the embodiment, the container side shutter 54 is located to leave a space from the spout 68. Therefore, when the ink container 22 is attached/detached to the container installed part 32, even if the container side shutter 54 opens/closes the spout 68, it is not possible that the ink adhered around the spout 68 is trailed and spread by the container side shutter 54.

As mentioned above, it is possible to restrain the ink leakage and ink trailing in the attachment/detachment of the ink container 22, thereby surely preventing the worker's hand and the apparatus's inside and circumference from being dirtied by the ink.

In addition, because, to the upper face of the bottom board 71 of the container side shutter 54, the liquid absorbing member 77 is attached to leave the space from the spout 68, the ink dropped from the spout 68 can be caught by the liquid absorbing member 77. Therefore, even if the ink container 22 removed from the container installed part 32 is tilted, it is possible to surely prevent the worker's hand and the apparatus's inside and circumference from being dirtied by the ink dropped from the container shutter 54.

In the embodiment, as the container side shutter 54, a slidable shutter moving in the forward/backward directions is used. On the other hand, in another embodiment, a rotatable shutter may be provided as the container side shutter 54.

In the embodiment, the liquid absorbing member 77 is made of the sponge. On the other hand, in a further embodiment, the liquid absorbing member 77 may be made of an optional material, such as porous ceramic, plastics or high polymer absorbent.

Although as the embodiment, configurations of the disclosure are applied to the printer 1 as the inkjet image forming apparatus, as a furthermore embodiment, the ideas of the disclosure may be applied to another inkjet image forming apparatus, such as a copying machine, a facsimile or a multifunction machine.

What is claimed is:

1. An inkjet image forming apparatus comprising:

an ink container configured to store an ink; and a container installed part to which the ink container is attached/detached along an installing direction, wherein the ink container includes a container case having a lower face side to which a supplying port discharging the ink is located, and a shutter located outside the lower face of the container case to leave a space from the supplying port, being movable along the lower face of the container case, and being switchable between a closing state covering a bottom of the supplying port and an opening state exposing the supplying port.

2. The inkjet image forming apparatus according to claim 1, wherein to an upper face of the shutter, a liquid absorbing member is attached so that the liquid absorbing member is located to leave a space from the supplying port in a situation of the shutter in the closing state.

3. The inkjet image forming apparatus according to claim 2, wherein the liquid absorbing member is made of a sponge, a porous ceramic, plastics or a high polymer absorbent.

4. The inkjet image forming apparatus according to claim 1, wherein on an upper face side of the container installed part, a guide protrusion is protruded, the shutter has a hook to come into contact with the guide protrusion, when the ink container is pushed to a first position of the container installed part, the guide protrusion stops the hook in an engaged state to restrict movement of the shutter to a rear side in the installing direction, and when the ink container is pushed to a second position being at the rear side of the first position in the installing direction, the container case moves to the rear side in the installing direction relatively to the shutter and the shutter is switched from the closing state to the opening state.

5. The inkjet image forming apparatus according to claim 4, wherein in a bottom face of the container case, an engaging board having an engaging depression to engage with the hook is protruded when the ink container is partway installed to the first position of the container installed part, the engagement of the hook with the engaging depression is released so that the shutter gets in a switchable state from the closing state to the opening state, and when the ink container is partway pulled out to a third position being at a front side of the first position in the installing direction, the hook engages with the engaging depression to keep the closing state of the shutter.

6. The inkjet image forming apparatus according to claim 1, wherein the supplying port is provided in an end at front side in the installing direction of the container case, in an end at front side in the installing direction of the container installed part, an upward/downward movable needle is provided and, below the needle, a lever swingable in upward and downward directions is provided, and when the lever is lifted in the closing state of the shutter, the lever pushes the needle upward so that of the needle is inserted in the supplying port.

7. The inkjet image forming apparatus according to claim 1, wherein the shutter has a bottom board, and a pair of side boards protruded upward at both sides of the bottom board.

8. The inkjet image forming apparatus according to claim 7, wherein in both ends of the bottom board, protruded boards are protruded upward.

9. The inkjet image forming apparatus according to claim 1, wherein the shutter is supported in a movable state in the installing direction by the container case.

10. An ink container storing an ink and being attached/detached to a container installed part provided in an inkjet image forming apparatus along an installing direction, comprising:

a container case having a lower face side to which a supplying port discharging the ink is located, and a shutter located outside the lower face of the container case to leave a space from the supplying port, being movable along the lower face of the container case, and being switchable between a closing state covering a bottom of the supplying port and an opening state exposing the supplying port.

11. The ink container according to claim 10, wherein to an upper face of the shutter, a liquid absorbing member is attached so that the liquid absorbing member is located to leave a space from the supplying port in a state of the shutter being in the closing state.

12. The ink container according to claim 11, wherein the liquid absorbing member is made of a sponge, a porous ceramic, plastics or a high polymer absorbent.

13. The ink container according to claim 10, wherein on an upper face side of the container installed part, a guide protrusion is protruded, the shutter has a hook to come into contact with the guide protrusion, when the ink container is pushed to a first position of the container installed part, the guide protrusion stops the hook in an engaged state to restrict movement of the shutter to a rear side in the installing direction, and when the ink container is pushed to a second position being at the rear side of the first position in the installing direction, the container case moves to the rear side in the installing direction relatively to the shutter and the shutter is switched from the closing state to the opening state.

14. The ink container according to claim 13, wherein in a bottom face of the container case, an engaging board having an engaging depression to engage with the hook is protruded when the ink container is partway installed to the first position of the container installed part, the engagement of the hook with the engaging depression is released so that the shutter gets in a switchable state from the closing state to the opening state, and when the ink container is partway pulled out to a third position being at a front side of the first position in the installing direction, the hook engages with the engaging depression to keep the closing state of the shutter.

15. The ink container according to claim 10, wherein the supplying port is provided in an end at front side in the installing direction of the container case, in an end at front side in the installing direction of the container installed part, an upward/downward movable needle is provided and, below the needle, a lever swingable in upward and downward directions is provided, and when the lever is lifted in the closing state of the shutter, the lever pushes the needle upward so that of the needle is inserted in the supplying port.

16. The ink container according to claim 10, wherein the shutter has a bottom board, and a pair of side boards protruded upward at both sides of the bottom board.

17. The ink container according to claim 16, wherein in both ends of the bottom board, protruded boards are protruded upward.

18. The ink container according to claim 10, wherein the shutter is supported in a movable state in the installing direction by the container case.

* * * * *